US010009693B2

(12) United States Patent
van Halteren et al.

(10) Patent No.: US 10,009,693 B2
(45) Date of Patent: Jun. 26, 2018

(54) RECEIVER HAVING A SUSPENDED MOTOR ASSEMBLY

(71) Applicant: Sonion Nederland B.V., Hoofddorp (NL)

(72) Inventors: Aart Zeger van Halteren, Woudenberg (NL); Adrianus Maria Lafort, Delft (NL); Rasmus Voss, The Hague (NL); Caspar Titus Bolsman, Amsterdam (NL); Andreas Tiefenau, Koog a/d Zaan (NL); Paul Christiaan van Hal, Amsterdam (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days. days.

(21) Appl. No.: 15/008,672

(22) Filed: Jan. 28, 2016

(65) Prior Publication Data

US 2016/0227328 A1 Aug. 4, 2016

(30) Foreign Application Priority Data

Jan. 30, 2015 (EP) ..... 15153247

(51) Int. Cl.
*H04R 11/02* (2006.01)
*H04R 25/00* (2006.01)
(Continued)

(52) U.S. Cl.
CPC ..... *H04R 11/02* (2013.01); *H04R 1/02* (2013.01); *H04R 11/04* (2013.01); *H04R 25/453* (2013.01);
(Continued)

(58) Field of Classification Search
CPC ..... H04R 11/00; H04R 11/02; H04R 11/04; H04R 11/06; H04R 11/14; H04R 1/2892;
(Continued)

(56) References Cited

U.S. PATENT DOCUMENTS 3,313,892 A * 4/1967 Cross ..... H04R 11/00 381/418
3,560,667 A * 2/1971 Carlson ..... H04R 11/00 381/386
(Continued)

FOREIGN PATENT DOCUMENTS

EP 1353531 A2 10/2003
EP 1555850 A1 7/2005
(Continued)

OTHER PUBLICATIONS

Extended European Search Report for Application No. EP 16153075.3, dated Jun. 3, 2016 (4 pages).
(Continued)

*Primary Examiner* — Joshua Kaufman
(74) *Attorney, Agent, or Firm* — Nixon Peabody LLP

(57) ABSTRACT

A receiver including a housing defining a chamber, and a motor assembly that includes a magnet assembly and an armature. The receiver includes a diaphragm operationally attached to the armature. The motor assembly is attached to the housing by a movable suspension structure. A method of reducing vibrations includes providing a housing defining a chamber, providing a motor assembly including a magnet assembly and an armature, providing a diaphragm, providing a movable suspension structure, attaching the diaphragm to the armature, and attaching the motor assembly to an inner wall of the housing by the movable suspension structure.

11 Claims, 8 Drawing Sheets

(51) Int. Cl.
*H04R 1/02* (2006.01)
*H04R 11/04* (2006.01)
*H04R 1/28* (2006.01)

(52) U.S. Cl.
CPC ..... *H04R 25/604* (2013.01); *H04R 1/2896* (2013.01); *H04R 2400/07* (2013.01)

(58) Field of Classification Search
CPC ..... H04R 1/2896; H04R 2400/03; H04R 2400/07; H04R 31/006; H04R 9/025; H04R 1/025; H04R 2209/024; H04R 2209/027; H04R 25/608; H04R 1/1075; H04R 1/2873
See application file for complete search history.

(56) References Cited

U.S. PATENT DOCUMENTS 3,588,383 A * 6/1971 Carlson ..... H04R 11/00 381/386
3,617,653 A * 11/1971 Tibbetts ..... H04R 11/02 310/36
4,126,769 A * 11/1978 Broersma ..... H04R 7/04 381/418
5,193,116 A * 3/1993 Mostardo ..... H04R 11/02 381/324
5,647,013 A * 7/1997 Salvage ..... H04R 11/02 381/312
5,809,158 A * 9/1998 van Halteren ..... H04R 11/00 381/322
5,913,815 A * 6/1999 Ball ..... H04R 25/606 600/25
6,075,870 A * 6/2000 Geschiere ..... H04R 11/00 29/595
6,208,237 B1 * 3/2001 Saiki ..... H04M 1/03 340/388.1
6,211,775 B1 * 4/2001 Lee ..... G08B 6/00 340/407.1
6,466,682 B2 * 10/2002 An ..... B06B 1/045 381/396
6,526,153 B2 * 2/2003 Tibbetts ..... H04R 11/00 381/412
6,658,134 B1 * 12/2003 van Hal ..... H04R 11/02 381/417
6,788,796 B1 9/2004 Miles et al.
6,810,128 B2 * 10/2004 Kaneda ..... B06B 1/045 340/388.1
6,831,577 B1 12/2004 Furst
6,853,290 B2 2/2005 Jorgensen et al.
6,859,542 B2 2/2005 Johannsen et al.
6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,062,058 B2 6/2006 Steeman et al.
7,062,063 B2 6/2006 Hansen et al.
7,072,482 B2 7/2006 Van Doorn et al.
7,076,079 B2 * 7/2006 Chung ..... B06B 1/045 381/396
7,088,839 B2 8/2006 Geschiere et al.
7,110,560 B2 9/2006 Stenberg
7,110,564 B2 * 9/2006 Son ..... H04R 15/00 340/388.1
7,136,496 B2 11/2006 van Halteren et al.
7,142,682 B2 11/2006 Mullenborn et al.
7,164,776 B2 * 1/2007 Miller ..... H04R 11/04 181/171
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 van Heltren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosh et al.
7,336,794 B2 2/2008 Furst et al.
7,376,240 B2 5/2008 Hansen et al.
7,403,630 B2 7/2008 Jorgensen et al.
7,408,444 B2 * 8/2008 Dufosse ..... H04R 9/06 340/384.1
7,415,121 B2 8/2008 Mögelin et al.
7,425,196 B2 9/2008 Jorgensen et al.
7,454,025 B2 * 11/2008 Saiki ..... H04R 1/2819 381/161
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 * 3/2011 Madaffari ..... H04R 9/025 181/144
7,946,890 B1 5/2011 Bondo et al.
7,953,241 B2 5/2011 Jorgensen et al.
7,961,553 B2 * 6/2011 Kang ..... H04R 1/24 367/182
7,961,899 B2 6/2011 Van Halteren et al.
7,970,161 B2 6/2011 van Halteren
7,995,789 B2 * 8/2011 Tsangaris ..... H04R 11/00 381/412
8,098,854 B2 1/2012 van Halteren et al.
8,101,876 B2 1/2012 Andreasen et al.
8,103,039 B2 1/2012 van Halteren et al.
8,160,283 B2 * 4/2012 Saltykov ..... H04R 11/02 381/318
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,416,980 B2 * 4/2013 Kang ..... H04R 11/02 381/396
8,509,468 B2 8/2013 van Halteren et al.
8,526,651 B2 9/2013 Lafort et al.
8,526,652 B2 9/2013 Ambrose et al.
8,712,084 B2 * 4/2014 Mocking ..... H04R 11/02 381/182
9,432,774 B2 * 8/2016 Bolsman ..... H04R 11/02
9,485,585 B2 * 11/2016 McCratic ..... H04R 9/025
2002/0061113 A1 * 5/2002 van Halteren ..... H04R 25/65 381/322
2002/0146141 A1 * 10/2002 Geschiere ..... H04R 25/604 381/368
2004/0258260 A1 * 12/2004 Thompson ..... H04R 7/20 381/312

(56) References Cited

U.S. PATENT DOCUMENTS

2005/0111688 A1* 5/2005 Wilmink ..... H04R 7/18 381/396
2005/0147272 A1* 7/2005 Hyre ..... H04R 9/06 381/398
2005/0152574 A1* 7/2005 Van Banning ..... H04R 11/02 381/417
2005/0276434 A1* 12/2005 Kobayashi ..... H04R 9/06 381/396
2007/0058833 A1* 3/2007 Van Halteren ..... H04R 11/02 381/415
2010/0014700 A1* 1/2010 Zhou ..... H04R 11/02 381/380
2010/0103778 A1* 4/2010 Kang ..... H04R 1/24 367/189
2010/0284561 A1 11/2010 Miller et al.
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0033849 A1* 2/2012 Kang ..... H04R 11/02 381/412
2012/0140966 A1 6/2012 Mocking et al.
2012/0155683 A1 6/2012 van Halteren
2012/0155694 A1* 6/2012 Reeuwijk ..... H04R 11/02 381/396
2012/0255805 A1* 10/2012 van Halteren ..... H04R 1/2873 181/199
2013/0028451 A1 1/2013 de Roo
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.
2013/0195311 A1* 8/2013 Sahyoun ..... H04R 1/2834 381/395
2014/0146995 A1* 5/2014 Adelman ..... H04R 11/02 381/414
2014/0348369 A1* 11/2014 Nevill ..... H04R 1/2896 381/345
2015/0207392 A1* 7/2015 Iwakura ..... H04R 11/02 310/25
2015/0245141 A1* 8/2015 van Halteren ..... H04R 7/02 381/398
2015/0289060 A1* 10/2015 Bolsman ..... H04R 11/02 381/417
2015/0319526 A1* 11/2015 Kunimoto ..... H04R 1/10 381/74
2015/0372580 A1* 12/2015 Lucas ..... H04R 9/027 381/418
2016/0205479 A1* 7/2016 Tomar ..... H04R 7/26 381/398

FOREIGN PATENT DOCUMENTS

EP 1353531 A3 12/2006
WO 2013/138234 A1 9/2013

OTHER PUBLICATIONS

European Search Report corresponding to co-pending European Patent Application No. 15153247.0, European Patent Office, dated Sep. 7, 2015; (4 pages).

* cited by examiner

RECEIVER HAVING A SUSPENDED MOTOR ASSEMBLY

CROSS-REFERENCE TO RELATED APPLICATION

This application claims the benefit of European Patent Application Serial No. 15153247.0, filed Jan. 30, 2015, and titled "A receiver having a suspended motor assembly," which is incorporated herein by reference in its entirety.

FIELD OF THE INVENTION

The present invention relates to a receiver comprising a motor assembly with a magnet assembly and an armature, and a diaphragm operationally attached to the armature.

BACKGROUND OF THE INVENTION

Traditionally, a motor assembly is fixedly attached to the receiver housing inside a chamber defined by the housing. However, as production of sound will cause the motor assembly to vibrate, the receiver itself will vibrate during operation which affects the hearing aid due to interaction with other parts of the hearing aid.

SUMMARY OF INVENTION

It is an object of embodiment of the invention to provide an improved receiver.

It is a further object of embodiments of the invention to provide a receiver in which vibrations are reduced compared to traditional receivers.

According to a first aspect, the invention provides a receiver comprising:

a housing defining a chamber, a motor assembly comprising:

a magnet assembly, and an armature, and a diaphragm operationally attached to the armature, wherein the motor assembly is attached to the housing by a movable suspension structure.

The receiver is adapted to transform electrical energy into mechanical energy by movement of the armature whereby sound waves may be created by movement of the diaphragm which is operationally attached to the armature. The housing may comprise an output opening configured to output sound from the chamber.

The receiver may be adapted to form part of any hearing aid, such as a Behind-the-Ear (BTE) device, an In the Ear (ITE) device, a Receiver in the Canal (RIC) device, or any other hearing aid. In the context of the present invention, the term "hearing aid" shall be understood as an electromagnetic device which is adapted to amplify and modulate sound and to output this sound to a user, such as into the ear canal of a user.

The receiver comprises a motor assembly and an armature.

In one embodiment the motor assembly comprises a magnet assembly for providing a magnetic field in an air gap, where the armature comprises a first leg extending in a first direction through the air gap.

It should be understood, that the present invention is not limited to balanced receivers. Also moving coil receivers, electrostatic receivers, and other receivers are within the scope of the invention.

The magnet assembly for providing a magnetic field in an air gap through which the first leg extends may be provided by a first and a second magnet portion positioned on opposite sides of the first leg and defining an air gap between them. In one embodiment, the first and second magnet portions are separate magnets which provide a magnetic field. In an alternative embodiment, the first and second magnet portions are two parts of a single magnet, e.g. formed as a U-shaped magnet, or the magnet assembly may be formed by one magnet and a yoke of a magnetically conducting material.

The armature may be made from any type of material, element and/or assembly able to guide or carry a magnetic flux. The armature may be electrically conducting or not.

The armature may comprise a first leg extending in a first direction through the air gap. The first leg may extend primarily in the longitudinal direction, i.e. the direction in which the armature has the longest extend.

The receiver further comprises a diaphragm which is operationally attached to the armature, such that movement of the armature is transferred to the diaphragm. It will be appreciated that movement of the diaphragm causes sound waves to be generated. In one embodiment, the diaphragm is operationally attached to the armature by means of a diaphragm connecting member, such as a drive pin. Alternatively, the diaphragm may itself be attached to the armature.

The diaphragm may comprise a plastic material, such as a polymer, or alternatively a metal material such as aluminium, nickel, stainless steel, or any other similar material. It should however be understood, that the diaphragm may comprise a plurality of materials. The diaphragm may divide the chamber into two chambers, such as a front volume and a back volume.

By attaching the motor assembly to the housing by a movable suspension structure inside the chamber defined by the housing, the motor assembly can move in the chamber, whereby it may be possible to decouple the mass of the motor assembly from the housing and thus isolate movements of the motor assembly from the housing. Consequently, vibration transfer from the receiver may be reduced, whereby the vibration force on the outer surface of the receiver may be reduced.

It should be understood that the movable suspension structure may particularly be the only connection between the motor assembly and an inner wall of the housing, whereby the motor assembly can move in the chamber only attached by the suspension structure. Thus, in one embodiment, the motor assembly is only attached to the housing in the chamber by a movable suspension structure.

In other words, the motor assembly may be floating in the chamber while only being attached to the housing by the movable suspension structure. Thus, the suspension structure is formed as a compliant element which holds the motor assembly in the chamber. The suspension structure may be formed as a single element or of a plurality of elements.

The movable suspension structure may be attached to an inner wall of the housing at a single attachment point or at a plurality of attachments points. This will limit the area at which the motor assembly is attached to the inner wall of the housing, thereby allowing the motor assembly to move more freely in the chamber.

It should be understood, that the movable suspension structure may form part of the motor assembly or may alternatively be a separate element allowing the motor assembly to move within the chamber while at the same time being attached to the housing.

To facilitate dampening of vibration transfer, the motor assembly may be configured for pivotal movement around a pivot axis being substantially perpendicular to the first direction. This may be achieved by arranging the suspension structure at an end face of the motor assembly, and particularly to arrange the suspension structure at an end face which terminates the motor assembly in the first direction. This may allow the motor assembly to pivot around the pivot axis in the first direction, whereby the largest deflection will be at the free end of the motor assembly opposite to the end face at which the motor assembly is movably attached to the housing.

The movable suspension structure may in one embodiment comprise a hinge structure, such as a metal flexure hinge. Flexure hinges provide a balance between large compliance in the first direction and low compliance in the remaining translational degrees of freedom. In one embodiment, the suspension structure may comprise two flexure hinges arranged in parallel at the end face thereby reducing the possibilities of movement of the motor assembly in other directions than around the pivot axis.

Alternatively, a second diaphragm may form the movable suspension structure or form part of the movable suspension structure. In this embodiment, the motor assembly may be rigidly attached to the second diaphragm which may be movably attached to the housing to allow pivotal movement of the motor assembly with the second diaphragm in the housing.

It should be understood, that the movable suspension structure may also comprise other elements, such as spirals and similar elements allowing for pivotal movement of the motor assembly in the housing, such as leaf springs, torsion springs, a membrane suspension, a suspension made from a material having a low stiffness, such as a gel, etc.

The movable suspension structure may be chosen so that the resonance frequency for movement of the motor assembly with the suspension structure is less than 500 Hz, whereby the resonance frequency may be out of the range where vibrations cause problems for hearing aids.

It should be understood, that pivotal suspension is an example of suspension. Other suspensions, such as translational suspensions may also be used; e.g. by providing the suspension structure in the form of two springs at one side of the motor assembly to allow lateral movement of the motor assembly; i.e. movement substantial perpendicular to the first direction.

As the receiver may be exposed to mechanical shocks, e.g. if dropped on the floor, it may be an advantage if the receiver additionally comprises a limiting member configured to decrease relative movement between the housing and the motor assembly. The limiting member may limit deflection to a maximum of 100 μm. It should however be understood, that the characteristics of the limiting member may depend on e.g. the size and/or weight of at least some of the elements of the receiver.

The limiting member may comprise a non-linear spring element, i.e. a spring element having a spring constant which is very small for small displacements and a spring constant being considerably higher for larger displacement thereby limiting the impact of dropping.

Alternatively, the limiting member may be formed as a slot/an opening into which the motor assembly extends or into which an element attached to the motor assembly extends. Movement of the motor assembly can be limited by the size of the slot/opening in the movement direction.

The armature may form an E-shape with three legs extending substantially parallel in the first direction. The first leg may form the central leg of three legs. The two other legs extending in the same direction may be arranged so that they do not extend through the air gap, but in parallel to the air gap.

The movable suspension structure may be arranged at the part of the E-shaped armature which connects the three legs whereby the legs may pivot around the pivot axis with the largest deflection at the free ends of the three legs.

In an alternative embodiment, the movable suspension structure may be arranged below or above the motor assembly to enable movement of the motor assembly primarily perpendicular to the first direction.

Furthermore, it should be understood, that the first leg may in one embodiment be the sole leg which extends through the air gap provided by the magnet assembly.

The receiver may comprise a coil which may comprise a number of windings defining a coil tunnel through which the first leg may extend. In one embodiment, the coil may form part of the motor assembly.

In embodiments were the armature is E-shaped, the coil tunnel and the air gap may be arranged adjacent to each other so that the first leg can extend though both the coil tunnel and the air gap.

In an alternative embodiment, the armature may form a U-shape with two legs extending substantially parallel in the first direction. The first leg may form one of the two legs. The other leg extending in the same direction may be arranged so that it does not extend through the air gap, but in parallel to the air gap.

In embodiments were the armature is U-shaped, the coil tunnel and the air gap may likewise be arranged adjacent to each other so that the first leg can extend though both the coil tunnel and the air gap. Alternatively, the coil tunnel and the air gap may be arranged above each other so that the first leg can extend through the air gap and so that second leg can extend through the coil tunnel. Thus, the first leg or the second leg forming the other one of the two legs of the U-shaped armature may extend through the coil tunnel.

The movable suspension structure may be arranged at the part of the U-shaped armature which connects the two legs whereby the legs may pivot around the pivot axis with the largest deflection at the free ends of the two legs.

However, as mentioned above, the movable suspension structure may be arranged below or above the motor assembly to enable movement of the motor assembly primarily perpendicular to the first direction.

In an alternative embodiment, the movable suspension structure may be arranged at the magnet assembly.

As mentioned above, the receiver may comprise a second diaphragm being operationally attached to the motor assembly, which in one embodiment may form the movable suspension structure.

A second diaphragm may further introduce a second front volume which may be acoustically connected to the first front volume. It should however be understood, that the two front volumes may in an alternative embodiment be provided with no acoustical connection there between.

The two front volumes may be connected by a common spout section. Alternatively, they may have separate spouts. The connections between the front volumes and the spout(s) may have different properties. As an example, is may be possible to modify the acoustic masse and resistance by changing e.g. the connections or by adding a grid.

The suspension of the motor assembly may reduce the sound output. The application of a second diaphragm may however counteract this reduction.

By suspending the motor assembly, the stiffness of the motor assembly and other parts of the receiver may be reduced. To at least partly counteract this, the receiver may further comprise a stiffening member coupling the magnet assembly to at least one of the diaphragm, the coil, and the second diaphragm.

The stiffening member may increase the motor assembly stiffness enough to ensure that there is no motor assembly resonances below 10 kHz, expect for the desired armature resonance.

The stiffening member may comprise a substantially rigid element, such as a metal plate or block, which may be arranged so that it connects the magnet assembly and the armature to provide a more rigid connection between these parts of the receiver as this may limit the potential movement of the motor assembly in the housing and thereby limit the deflection at the free end of the motor assembly.

By increasing the thickness of the second diaphragm and connecting it directly to the motor assembly, the stiffness my likewise be increased.

The motor assembly may further comprise a positioning element configured for variable positioning of the motor assembly relative to the diaphragm and/or the second diaphragm. This enables optimising of the front and back volumes, as the position of the motor assembly may be varied relative to at least one of the diaphragms.

According to a second aspect, the invention provides a hearing aid comprising a receiver according to the first aspect of the invention, wherein the housing is arranged in a shell formed by the hearing aid.

It should be understood, that a skilled person would readily recognise that any feature described in combination with the first aspect of the invention could also be combined with the second aspect of the invention, and vice versa.

The receiver according to the first aspect of the invention is very suitable for use in a hearing aid according to the second aspect of the invention. The remarks set forth above in relation to the receiver are therefore equally applicable in relation to the hearing aid.

According to a third aspect, the invention provides a method of reducing vibrations in a receiver, the method comprising the steps of:

providing a housing defining a chamber, providing a motor assembly comprising a magnet assembly and an armature, and providing a diaphragm, providing a movable suspension structure, attaching the diaphragm to the armature, and attaching the motor assembly to an inner wall of the housing by the movable suspension structure.

It should be understood, that a skilled person would readily recognise that any feature described in combination with the first aspect of the invention could also be combined with the third aspect of the invention, and vice versa.

The receiver according to the first aspect of the invention is very suitable for performing the method steps according to the third aspect of the invention. The remarks set forth above in relation to the receiver are therefore equally applicable in relation to the method.

BRIEF DESCRIPTION OF THE DRAWINGS

Embodiments of the invention will now be further described with reference to the drawings, in which.

DETAILED DESCRIPTION OF PREFERRED EMBODIMENTS

It should be understood that the detailed description and specific examples, while indicating embodiments of the invention, are given by way of illustration only, since various changes and modifications within the spirit and scope of the invention will become apparent to those skilled in the art from this detailed description.

Figure 1:
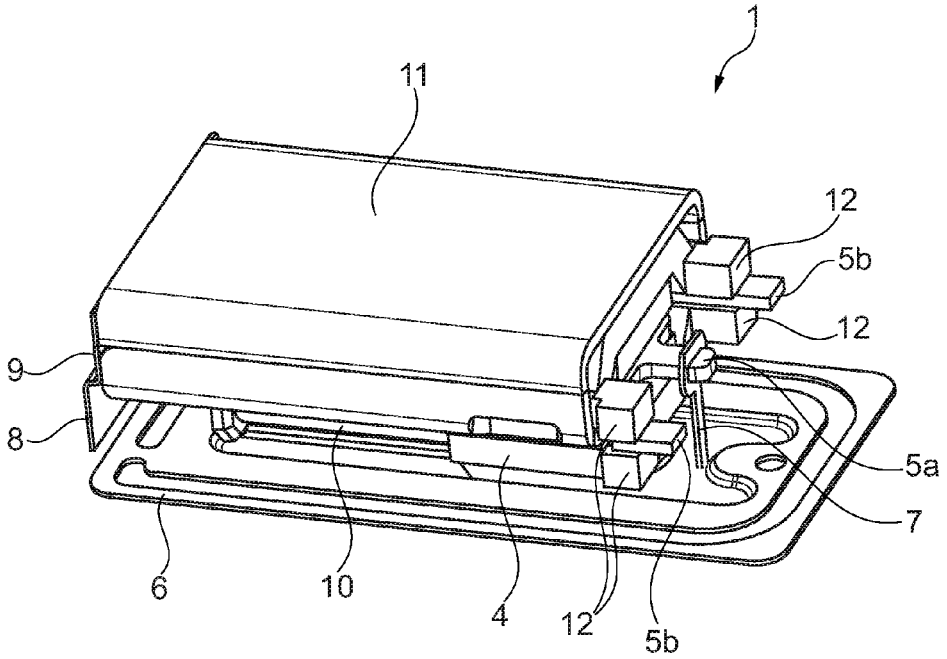
FIG. 1 illustrates an embodiment of a receiver according to the invention.

FIG. 1 illustrates an embodiment of a receiver 1 which comprises a housing 2 (see FIGS. 3*a*/3*b*) defining a chamber.

Additionally, the receiver 1 comprises a motor assembly 100 which comprises a magnet assembly 4 and an armature 5. In the illustrated embodiment, the armature 5 is E-shaped.

The magnet assembly 4 provides a magnetic field in an air gap. The armature 5 comprises a first leg 5*a* extending in a first direction through the air gap. The two other legs 5*b* of the E-shaped armature 5 extend parallel to the first leg 5*a* outside the air gap.

Furthermore, the receiver 1 comprises a diaphragm 6 which is operationally attached to the armature 5. In the illustrated embodiment, the diaphragm 6 is attached via the drive pin 7.

The motor assembly 100 is attached to the housing 2 by a movable suspension structure 8. By attaching the motor assembly to the housing 2 by the movable suspension structure 8, the motor assembly can move in the chamber, whereby the mass of the motor assembly can be decoupled from the housing to isolate movements of the motor assembly from the housing 2.

In the illustrated embodiment, the movable suspension structure 8 comprises a hinge (not shown) which forms part of a bent plate 9 which is attached to the motor assembly. The bent plate 9 increases rigidity of the movable suspension structure 8.

The receiver 1 further comprises a coil 10 which comprises a number of windings defining a coil tunnel through which the first leg 5*a* extends. In this embodiment, the coil tunnel and the air gap are arranged adjacent to each other so that the first leg 5*a* extends though both the coil tunnel and the air gap.

The receiver 1 additionally comprises a stiffening member 11 configured to counteract the decreased stiffness of the receiver. In the illustrated embodiment, the stiffening member 11 comprises a substantially rigid element, in the form of a metal plate which is arranged so that it connects the magnet assembly 4, the coil 10, and the armature 5 to provide a more rigid connection between these parts of the receiver 1.

Additionally, the receiver 1 comprises a limiting member 12 configured to decrease the maximal possible relative movement between the housing 2 and the motor assembly 100. In the illustrated embodiment, the limiting member 12 is formed by two sets of elongated blocks between which the two legs 5*b* of the E-shaped armature 5 can move thereby limiting the movement of the motor assembly 100 comprising the armature 5.

Figure 2A:
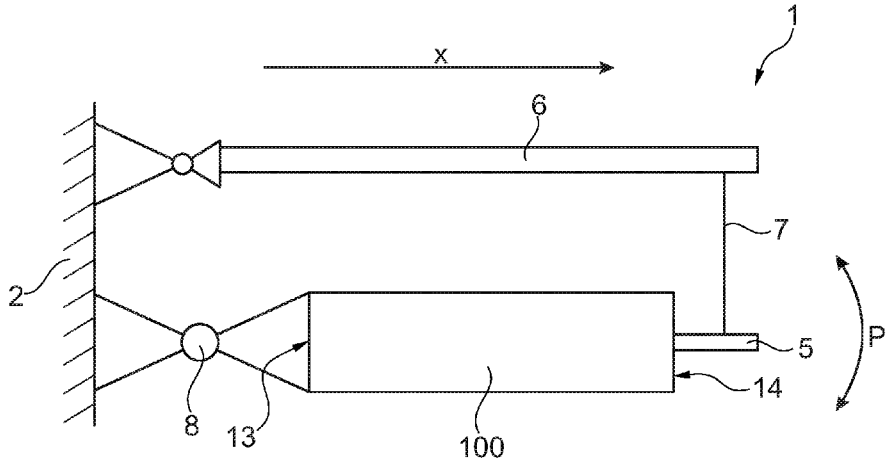
FIGS. 2*a* and 2*b* schematically illustrate different embodiments of a suspension element according to the invention.
Figure 2B:
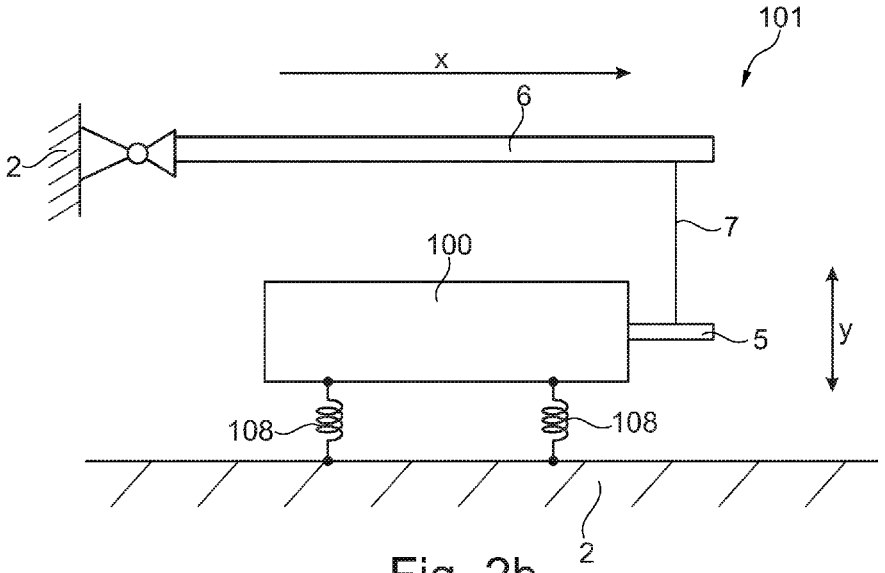

FIGS. 2*a* and 2*b* schematically illustrate different two embodiments of a receiver 1, 101 comprising two different suspension elements 8, 108.

The receiver 1 illustrated in FIG. 2*a* comprises a moveable suspension structure in the form of a hinge 8, which allows the motor assembly 100 to pivot around a pivot axis being substantially perpendicular to the first direction. At FIG. 2*a* the pivotal movement is illustrated by the arrow P, whereas the first direction is illustrated by the arrow X. As the suspension structure 8 is arranged at the end face 13 which terminates the motor assembly 100 in the first direction X, the largest deflection of the motor assembly 100 will be at the free end 14 of the motor assembly opposite to the end face at which the motor assembly 100 is movably attached to the housing 2.

Figure 3A:
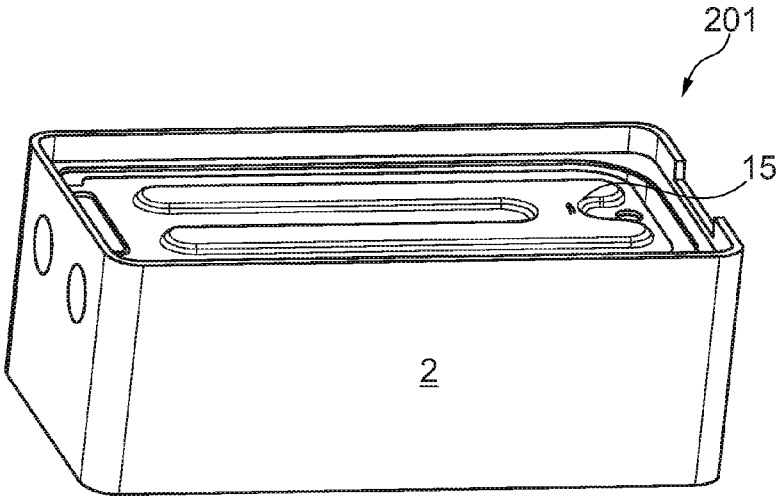
FIGS. 3*a* and 3*b* illustrate an embodiment of a housing for a receiver.
Figure 3B:
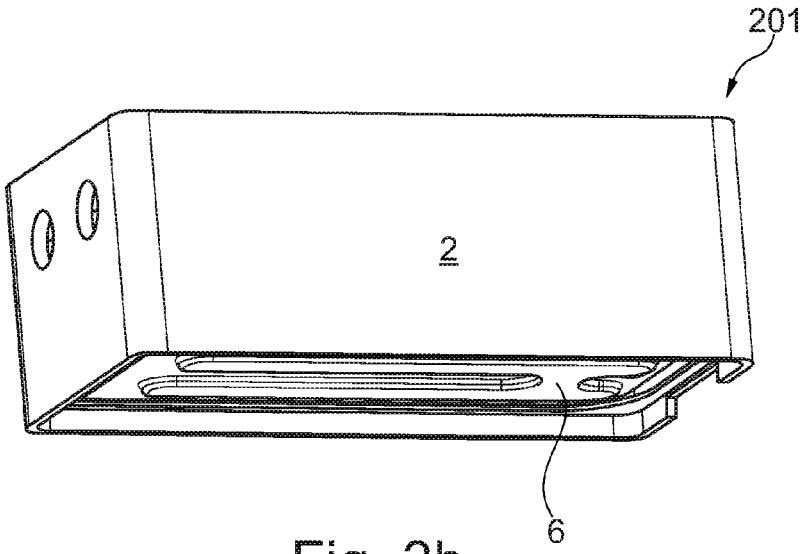

The receiver 101 illustrated in FIG. 2*b* comprises a moveable suspension structure in the form of two springs 108, which allows the motor assembly 100 to move in a direction Y being substantially perpendicular to the first direction X. FIGS. 3*a* and 3*b* illustrate an embodiment of a housing 2 for a receiver 201. The receiver 201 comprises a diaphragm 6 being operationally attached to the armature (not shown). Additionally, the receiver 201 comprises a second diaphragm 15 which forms part of the movable suspension structure, as shown in more details in FIG. 4.

Figure 4:
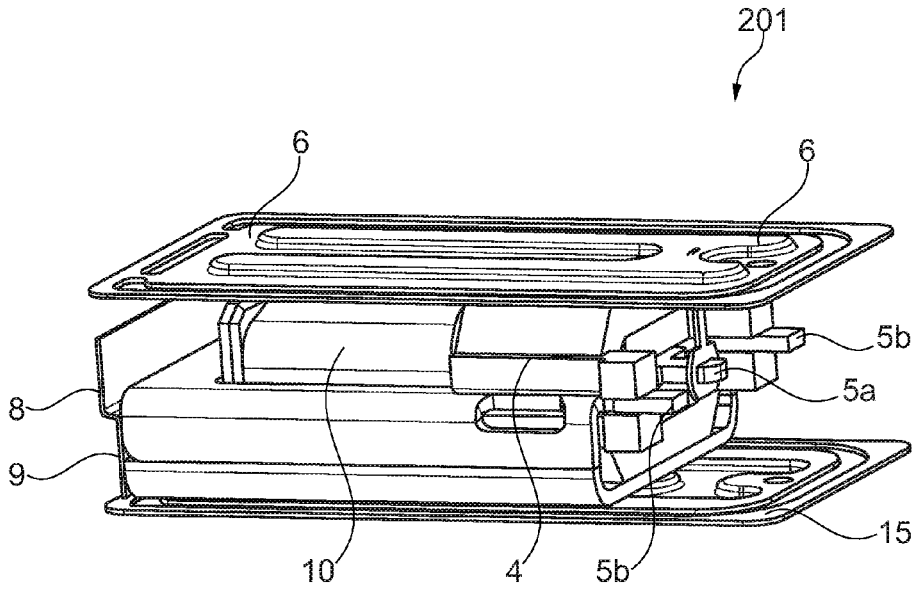
FIG. 4 illustrates an alternative embodiment of a receiver, FIGS. 5*a*-5*c* schematically illustrate a different embodiment of a suspension element according to the invention.

As illustrated in FIG. 4, the receiver 201 comprises a second diaphragm 15 which forms part of the movable suspension structure. The motor assembly is rigidly attached to the second diaphragm 15 which is movably attached to the housing 2 to allow pivotal movement of the motor assembly with the second diaphragm 12 in the housing 2.

Figure 5A:
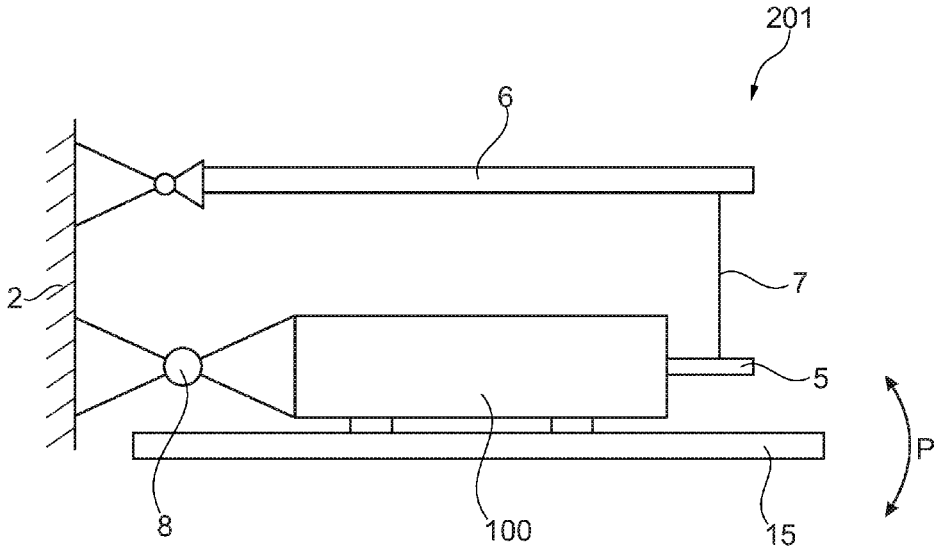
Figure 5B:
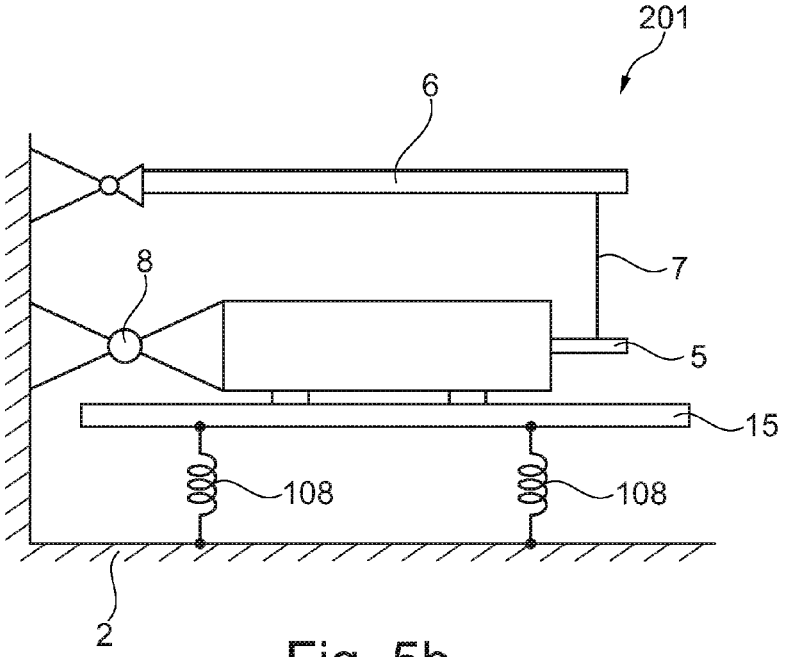
Figure 5C:
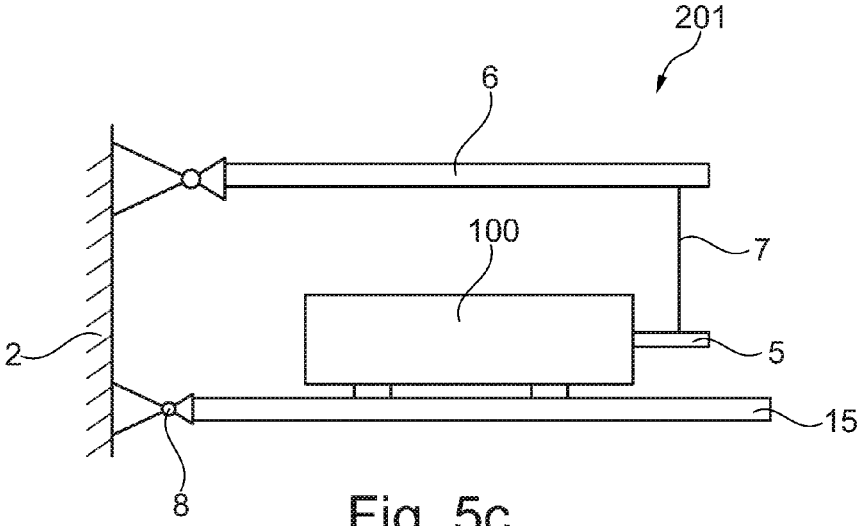

FIG. 5*a* schematically illustrates the embodiment of the receiver 201 comprising two diaphragms 6, 15 where the second diaphragm 15 is rigidly attached to the motor assembly 100. FIGS. 5*b* and 5*c* schematically illustrate a receiver 201 where the second diaphragm 15 forms part of the suspension element 8 in two different ways.

In FIG. 5*b*, the motor assembly 100 is attached to the housing 2 by the movable suspension structure 8 comprising a hinge which allows the motor assembly 100 to pivot around a pivot axis being substantially perpendicular to the first direction. Additionally, the motor assembly 100 is rigidly attached to the second diaphragm 15 which is movably attached to the housing 2 by two springs 108 allows the motor assembly 100 to move in a direction substantially perpendicular to the first direction. Consequently, the maximal pivotal movement enabled by the hinge 8 may be limited by the springs 108.

In FIG. 5*c*, the motor assembly 100 is rigidly attached to the second diaphragm 15 which is movably attached to the housing 2 by the movable suspension structure 8 comprising a hinge. This allows the motor assembly 100 and the second diaphragm to pivot around a pivot axis being substantially perpendicular to the first direction.

Figure 6:
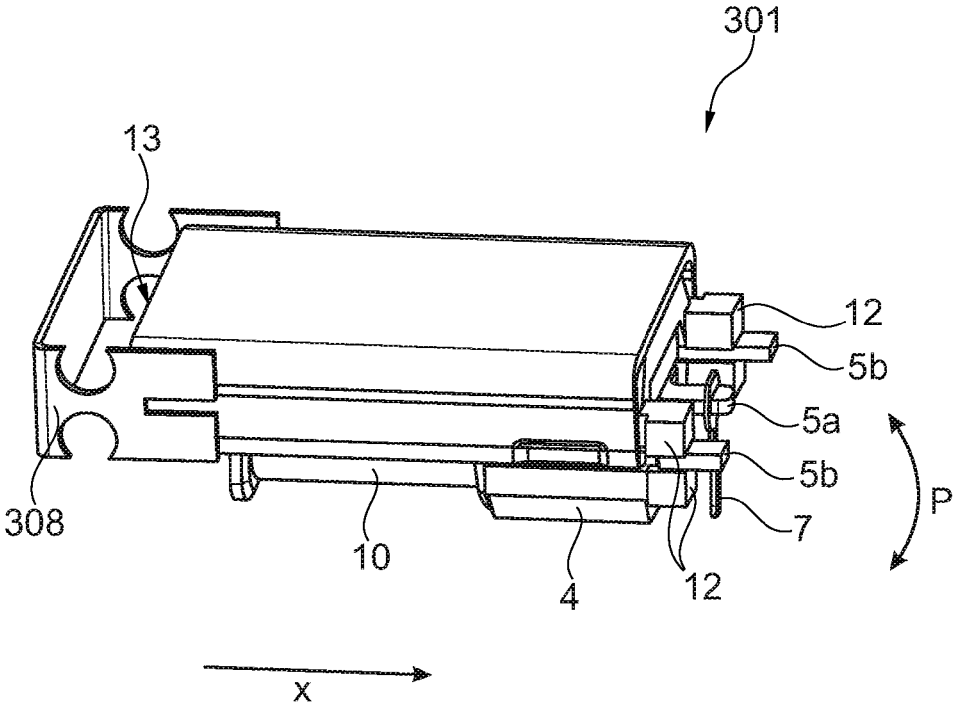
FIG. 6 illustrates a further alternative embodiment of a receiver, and FIGS. 7*a* and 7*b* schematically illustrate different embodiments of a limiting member according to the invention.

FIG. 6 illustrates a receiver 301 comprising an alternative movable suspension structure 308 comprising two metal flexure hinges. The two flexure hinges 308 arranged in parallel at the end face 13 reduces the possibilities of movement of the motor assembly in other directions than around the pivot axis being perpendicular to the first direction illustrated by the arrow X.

Figure 7A:
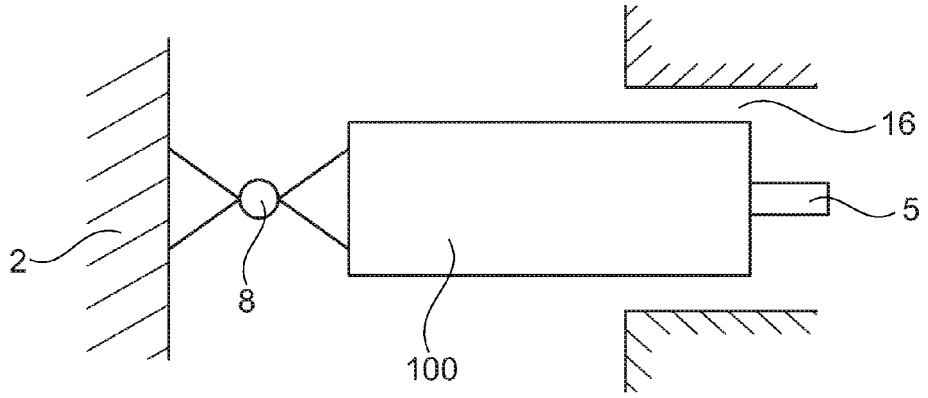
Figure 7B:
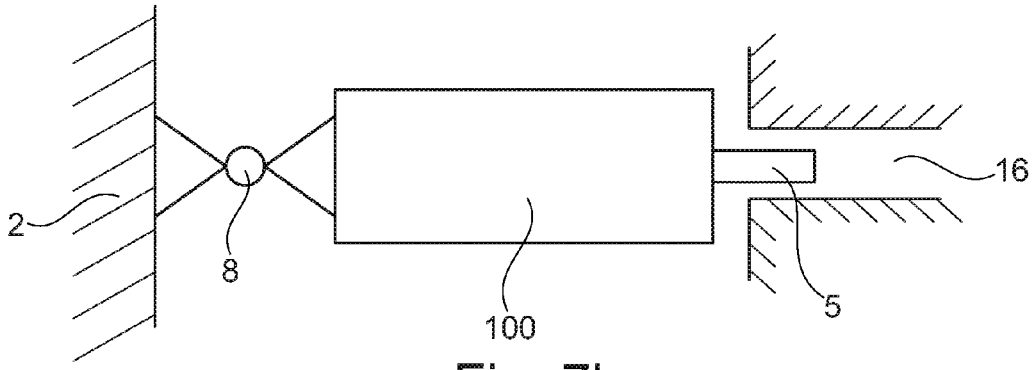

FIGS. 7*a* and 7*b* schematically illustrate two different embodiments of a limiting member 12, 112 according to the invention. In FIG. 7*a*, a part of the motor assembly 100 including the armature 5 extends into a slot 16 between two parts of the housing 2 whereby movement of the motor assembly 100 is limited. In the illustrated embodiment, the slot 16 is formed in a separate element 2' which is fixedly attached to the housing 2 whereby the slot 16 cannot move relative to the housing 2 thereby providing the required limitation of the movements of the motor assembly 100. It should be understood, that the slot in an alternative embodiment may form part of the inner wall of the housing.

In FIG. 7*b*, a part of the armature 5 extends into a slot 16 between two parts of the housing 2 which likewise limits movement of the motor assembly 100.

The invention claimed is:

1. A miniature receiver comprising:

a housing defining a chamber of the miniature receiver suitable for use in a hearing aid;

a motor assembly including a magnet assembly and an armature having at least a first leg and a second leg extending substantially parallel in a first direction; and a diaphragm operationally attached to the armature, wherein the motor assembly is attached at an end face thereof to a movable suspension structure to allow a free end of the motor assembly opposite to the end face thereof to move inside the chamber, wherein the movable suspension structure is attached to an inner wall of the housing at a single attachment point, wherein the motor assembly is configured for pivotal movement around a pivot axis that is substantially perpendicular to the first direction, wherein the movable suspension structure is configured for decoupling the mass of the motor assembly from the housing, the movable suspension structure is configured to isolate movement of the motor assembly from the housing, and the movable suspension structure is configured for reducing vibration transfer from the miniature receiver.

2. A receiver according to claim 1, further comprising a limiting member configured to decrease relative movement between the housing and the motor assembly.

3. A receiver according to claim 1, wherein the magnet assembly is configured for providing a magnetic field in an air gap, and wherein the first leg extends through the air gap.

4. A receiver according to claim 3, wherein the armature forms an E-shape with three legs extending substantially parallel in the first direction, and wherein the first leg forms the central leg of the three legs.

5. A receiver according to claim 4, wherein the first leg extends through a coil tunnel.

6. A receiver according to claim 1, wherein the armature forms a U-shape with two legs extending substantially parallel in the first direction.

7. A receiver according to claim 6, wherein the first leg or a second leg, forming the other one of the two legs of the U-shaped armature, extends through a coil tunnel.

8. A receiver according to claim 1, further comprising a second diaphragm being operationally attached to the motor assembly.

9. A receiver according to claim 1, further comprising a stiffening member coupling the magnet assembly to at least one of the diaphragm, the coil, and the second diaphragm.

10. A hearing aid comprising a receiver according to claim 1, wherein the housing is arranged in a shell formed by the hearing aid.

11. A method of reducing vibrations in a receiver, the method comprising the steps of:

providing a housing defining a chamber of the miniature receiver suitable for use in a hearing aid, providing a motor assembly including a magnet assembly and an armature having at least a first leg and a second leg extending substantially parallel in a first direction, providing a diaphragm, providing a movable suspension structure, attaching the diaphragm to the armature, attaching the motor assembly at an end face thereof to the movable suspension structure to allow a free end of the motor assembly opposite to the end face thereof to move inside the chamber, and attaching the movable suspension structure to an inner wall of the housing at a single attachment point such that the motor assembly is configured for pivotal movement around a pivot axis that is substantially perpendicular to the first direction, wherein the movable suspension structure is configured for decoupling the mass of the motor assembly from the housing, the movable suspension structure is configured to isolate movement of the motor assembly from the housing, and the movable suspension structure is configured for reducing vibration transfer from the miniature receiver.

* * * * *